US005660249A

United States Patent [19]

Powell et al.

[11] Patent Number: 5,660,249

[45] Date of Patent: Aug. 26, 1997

[54] ELEVATOR CABS TRANSFERRED HORIZONTALLY BETWEEN DOUBLE DECK ELEVATORS

[75] Inventors: Bruce A. Powell, Canton; Joseph Bittar, Avon; Frederick H. Barker, Bristol; Samuel C. Wan, Simsbury; Paul Bennett, Waterbury; Anthony Cooney, Unionville; Richard C. McCarthy, Simsbury, all of Conn.

[73] Assignee: Otis Elevator Company, Farmington, Conn.

[21] Appl. No.: 564,703

[22] Filed: Nov. 29, 1995

[51] Int. Cl.[6] ..... B66B 9/00

[52] U.S. Cl. ..... 187/249; 182/12

[58] Field of Search ..... 187/249, 410, 187/239, 256; 182/12, 13, 14

[56] References Cited

U.S. PATENT DOCUMENTS

| | | | |
|---|---|---|---|
| 1,939,729 | 12/1933 | Stark | 187/1 |
| 2,052,690 | 9/1936 | Austin | 187/16 |
| 5,090,515 | 2/1992 | Takahashi et al. | 187/249 |
| 5,464,072 | 11/1995 | Muller | 187/249 |

*Primary Examiner*—Kenneth Noland

[57] ABSTRACT

Horizontally moveable elevator cabs (22, 23) are transferred from the upper deck of a first car frame (26) to the upper deck of a second car frame (27) and from the lower deck of the second car frame to the lower deck of the first car frame. Three elevator hoistways, each with a double deck car frame are controlled by computer routines. A rack and pinion horizontal motive means, for moving the cab from car frame to car frame is also briefly disclosed.

3 Claims, 8 Drawing Sheets

CAR ONE UPPER
81
CAR ONE DIR
82
83
POS=TRNSFR FLR
128
TRNSFR UPPR FLG
CAB IN UPPR ONE
161
CAR ONE RUN FIG. 3
94
RST UPPR CAB/CAR LCK
162
REQ UPPR BOOM
163
EXTND UPPR BOOM
164
UPPR EJECT FLG
129
CAR/FLR INTRLK
130
UPPR COMMN INTRLK
139
SPD=0
131
LFT BRK
132
SET CAR/FLR LCK
133
EXTND UPPR BOOM
134
REQ UPPR BOOM CAR TWO
135
CLOS UPPR CAR DOORS
84
SET TRNSFR UPPR FLG
90
RST LNTRN
91
TRGT FLR=TRNSFR FLR
92
DIR=UP
93
Y
N

ELEVATOR CABS TRANSFERRED HORIZONTALLY BETWEEN DOUBLE DECK ELEVATORS

TECHNICAL FIELD

This invention relates to transferring a first horizontally moveable elevator cab from the lower deck of a first elevator car frame in a first hoistway to the lower deck of a second elevator car frame in a second hoistway while transferring a second cab from the upper deck of the second car frame to the upper deck of the first car frame, whereby two cabs may be moving in the two hoistways at the same time.

BACKGROUND ART

The sheer weight of the rope in the hoisting system of a conventional elevator limits their practical length of travel. To reach portions of tall buildings which exceed that limitation, it has been common to deliver passengers to sky lobbies, where the passengers walk on foot to other elevators which will take them higher in the building. However, the milling around of passengers is typically disorderly, and disrupts the steady flow of passengers upwardly or downwardly in the building.

All of the passengers for upper floors of a building must travel upwardly through the lower floors of the building. Therefore, as buildings become higher, more and more passengers must travel through the lower floors, requiring that more and more of the building be devoted to elevator hoistways (referred to as the "core" herein). Reduction of the amount of core required to move adequate passengers to the upper reaches of a building requires increases in the effective usage of each elevator hoistway. For instance, the known double deck car doubled the number of passengers which could be moved during peak traffic, thereby reducing the number of required hoistways by nearly half. Suggestions for having multiple cabs moving in hoistways have included double slung systems in which a higher cab moves twice the distance of a lower cab due to a roping ratio, and elevators powered by linear induction motors (LIMs) on the sidewalls of the hoistways, thereby eliminating the need for roping. However, the double slung systems are useless for shuttling passengers to sky lobbies in very tall buildings, and the LIMs are not yet practical, principally because, without a counterweight, motor components and energy consumption are prohibitively large.

In order to reach longer distances, an elevator cab may be moved in a first car frame in a first hoistway, from the ground floor up to a transfer floor, moved horizontally into a second elevator car frame in a second hoistway, and moved therein upwardly in the building, and so forth. However, only a single cab is moving at any time, while any other car frames are idly waiting in the hoistways. Therefore, the aforementioned system while being useful to reach great heights in the building, is wasteful of core.

DISCLOSURE OF INVENTION

Objects of the invention include improving the utilization of elevator hoistways in which horizontally moveable elevator cabs are transferred from a car frame in one hoistway to a car frame in another hoistway.

According to the present invention, adjacent, overlapping elevator hoistways have double deck car frames therein, a cab being transferred from the lower deck of one car frame to a lower deck of the other car frame as a cab is transferred from the upper deck of the other car frame to the upper deck of the lower car frame. According further to the invention, the cabs may be transferred in the upper and lower decks simultaneously.

The invention provides greater utilization of the elevator hoistways in the building while permitting elevator cabs to be moved two or more times the practical length of conventional elevators.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
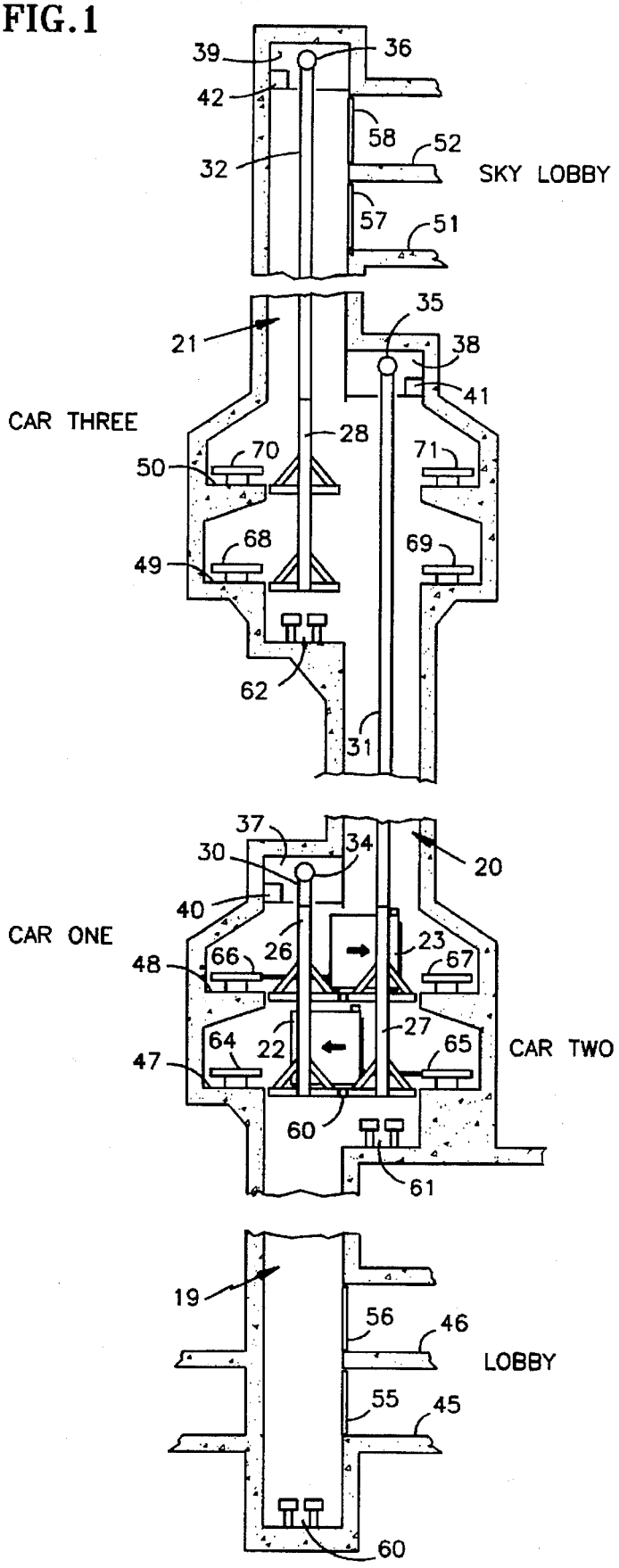
FIG. 1 is a simplified, stylized, partial, sectioned, side elevation view of an elevator shuttle system in accordance with the invention.

Referring now to FIG. 1, an elevator system comprises three separate hoistways 19–21 each of which contains a complete elevator, except for the passenger-containing cab portions, there being a pair of cabs 22, 23 which are transferred between the three hoistways 19–21. Each elevator includes a double deck frame 26–28, hoist ropes 30–32, a hoisting machine 34–36, including a motor, a sheave and a brake, disposed in a machine room 37–39 along with a car controller 40–42. For control purposes herein, the elevators in hoistways 19–21 are referred to as car one, car two and car three, respectively. Car one carries passengers between a pair of lobby floors 45, 46 and a first pair of transfer floors 47, 48, which represent a "transfer" floor for car one and a "low" floor for car two. Car two carries passengers from the first transfer floors 47, 48 to a second pair of transfer floors 49, 50. Car three transfers passengers between the second pair of transfer floors 49, 50 and a pair of upper lobby floors 51, 52, sometimes referred to as a "sky lobby", which may be a restaurant floor, an observation floor, or a lobby from which passengers may embark to still higher (or lower) floors by means of local elevators (with or without express runs). Access between the elevator cabs 22, 23 and the lobby floors 45, 46, 51, 52 is provided by hoistway doors 55–58, respectively. The bottom of each hoistway 19–21 may contain a buffer 60–62, as is known. Each elevator may have other equipment, such as a counterweight, governor, safeties and the like, known in double deck elevators, none of which are special for the present invention and therefore need not be shown herein.

At each transfer floor there are provided horizontal motive means, such as jack screw assemblies 64–71 for transferring the cabs 22, 23 from one frame 26–28 of one of the cars to a frame of another of the cars, of such as is described with respect to FIG. 6 hereinafter. The cabs 22–23 are disposed on wheels to permit rolling the cabs from a platform of one frame 26–28 to a platform of another frame 26–28. The cabs 22–23 have doors of the usual type (on the right-hand side as shown in FIG. 1) operated by a door operating mechanism to allow passenger access to the lower and upper lobby floors 45, 46, 51, 52. However, the doors are not opened at the transfer floors 47–50. Each of the cars is provided with floor locks which may, in this embodiment, simply comprise bistable solenoid plungers which can be moved into a locked position, where the plunger engages a plate supported in the hoistway, as shown in said co-pending application. Use of a dual coil, bistable solenoid allows energizing one coil to cause the plunger to engage as shown, after which the coil can be disenergized and the plunger will remain engaged; when the car is to move, the opposite coil can be operated to move the plunger out of engagement, and thereafter the plunger will remain out of engagement until the other coil is once again operated. The use of the floor locks is to reduce erratic motion of the car frames 26–28 due to variations in rope stretch, as the cabs are transferred from one frame to the other and vice versa. The plate may be combined with a sill (only one sill 60 being identified in FIG. 1) that allows the cabs 22, 23 to roll between car frames 26–28. Each of the car frames 26–28 also has a cab/car lock system which may comprise plungers which can move inwardly toward the cab so as to engage plates on the cab, as shown in said co-pending application, but not shown herein. Each frame may also have some form of proximity detector which can sense the presence of an element on each cab 22, 23 to provide a signal generally indicative of the fact that the cab is on a particular deck of a particular car, as shown in said co-pending application.

In transferring the cab from one frame 26–28 to another frame, it is desirable to maintain power for lighting in the cab, as well as to maintain signal circuitry for an alarm bell, a phone, and the door closure switch, at a minimum. In a shuttle system of the type illustrated in FIG. 1, traveling between lobby floors 45, 46 and 51, 52, with no choice as to any other destination floor, there is normally no need for a full car operating panel with car call buttons. Since the doors cannot be opened except when the cabs are in car one at the lower lobbies 45, 46 and when the cabs are in car three at the upper lobbies 51, 52, there is no need to maintain the capability for door opening as the cabs are transferred from one frame to another frame (or vice versa). In the present embodiment, power for lighting and circuits for the signals referred to hereinbefore may be maintained by means of umbilical cables which have two sided plug-socket assemblies which mate with corresponding socket/plug assemblies attached to respective booms which are controlled by boom rotating mechanisms on the respective frames, as shown in said aforementioned application. The socket/plug assembly of each cab is engaged with either one or the other or both of the socket/plug assemblies of one or two booms on the car frames at all times. The socket/plug assemblies on each of the booms each have a monostable solenoid plunger disposed therein which, in response to a release signal, will push the corresponding socket/plug assembly away from the socket/plug assembly of the cab, so as to disengage therefrom, thereby permitting the boom to be retracted when not in use.

In the embodiment of FIG. 1, the shaft 21 is disposed to the left of the shaft 20, immediately above the shaft 19. However, each of the shafts 20, 21 could be offset to the right of the shaft below it, as in said aforementioned copending application, if desired. Such a choice depends on building design criteria unrelated to the elevators. If such were the case, car two would only need a second boom to interact with the boom on car three. The invention is disclosed as using simple jack screw systems 64–71 which permit each car to push the cab off itself onto another car. The invention has been shown employing adjacent elevator shafts so that the travel distance for the cab is simply the width of a car frame, plus the width of the narrow sill 60 described hereinbefore. However, by providing for maintenance of communications and power during transfer, the cabs 22, 23 may travel a much greater distance between cars within the purview of this invention.

Figures 2, 2A, 2B:
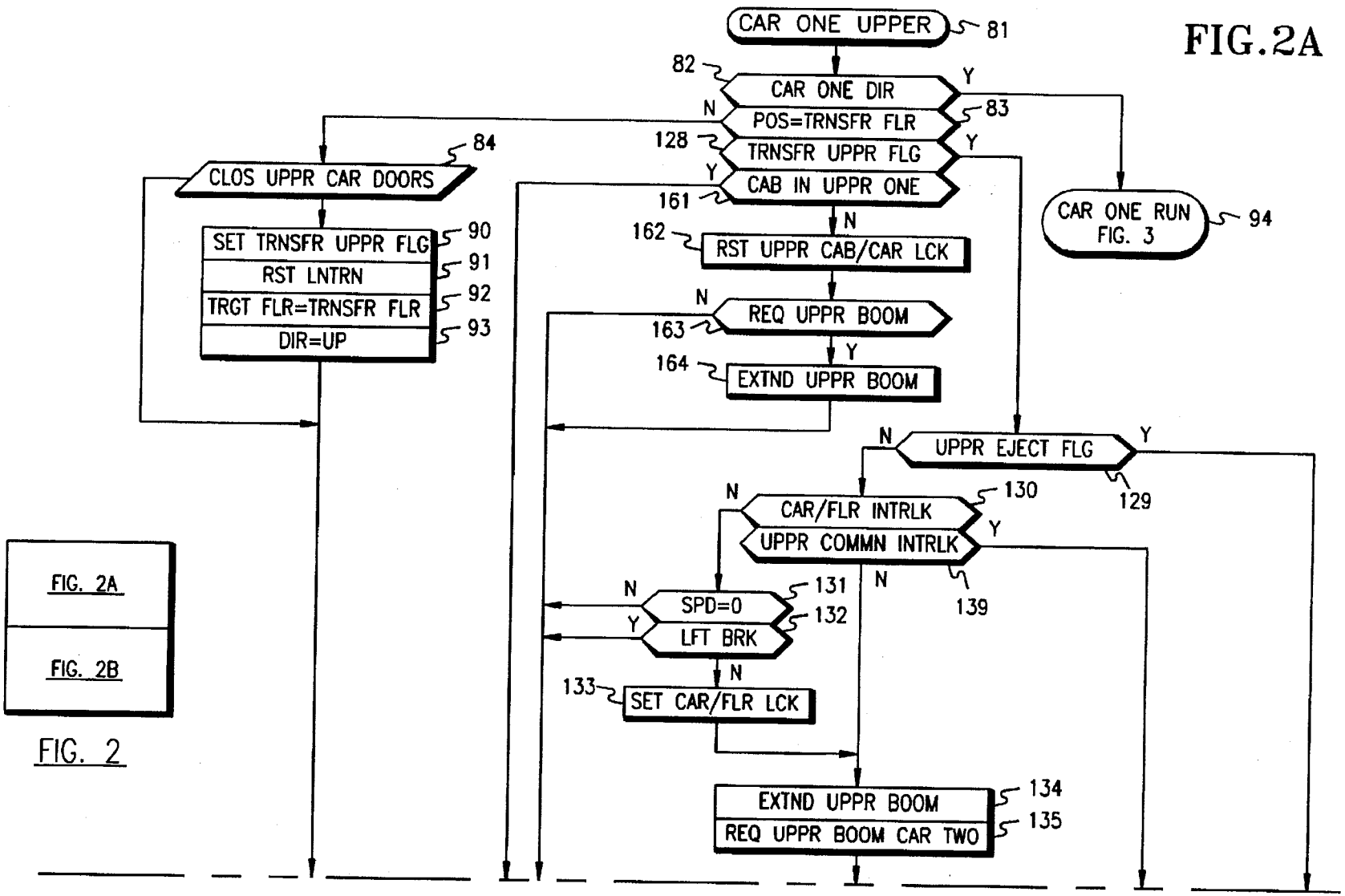
FIG. 2 is a logic flow diagram illustrating a portion of a routine which may be used controlling car one in the lowest shaft of FIG. 1, with a cab in its upper deck.
Figure 2B:
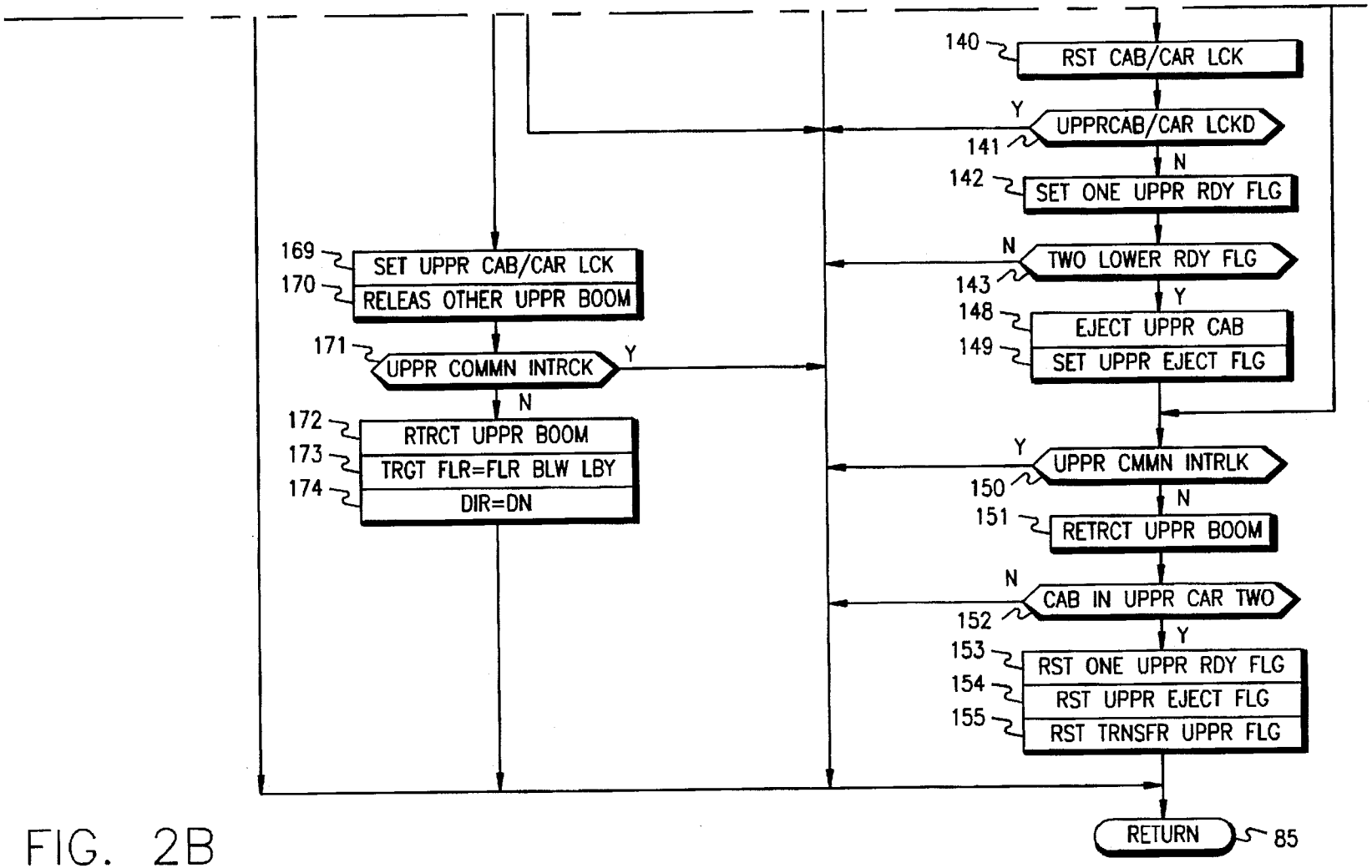

Referring now to FIG. 2, a control routine for car one may be implemented in a microprocessor which performs a variety of functions, not all of which are illustrated herein. The function may include door control for the cabs; upper and lower deck cab transfer and door controls, run controls, and motion control for any or all of the cars. The routine of FIG. 2 may be reached through an entry point 81 and a first test 82 determines if the car has motion direction commanded to it (that is, the command to go up or down). Assume that an elevator cab is in the upper deck of car one standing at the upper deck 46 of the lower lobby floor, with its doors fully open. In such case, the car does not have direction, so a negative result of test 82 will reach a test 83 to see if the position of the car is the transfer floor. For car one, the transfer floor means that the car is positioned with its upper and lower decks adjacent to the transfer floors 47, 48. Under the assumption, the car is at the lobby, so a negative result of test 83 reaches a subroutine 84. It will take many subsequent passes through the subroutine of FIG. 2 to ultimately close the doors; while this occurs, other programming is reached, repetitively through a return point 85. When the doors are closed, a step 90 sets a transfer upper flag; this flag is set to keep track of the fact that when the car arrives at a transfer floor, it has the cab and must transfer it to the other car. Next, a step 91 resets the lower lobby corridor lantern, a step 92 sets the target floor to be the transfer level, and a step 93 sets the car direction command to up. Then other programming is reached through the return point 85.

Figure 3:
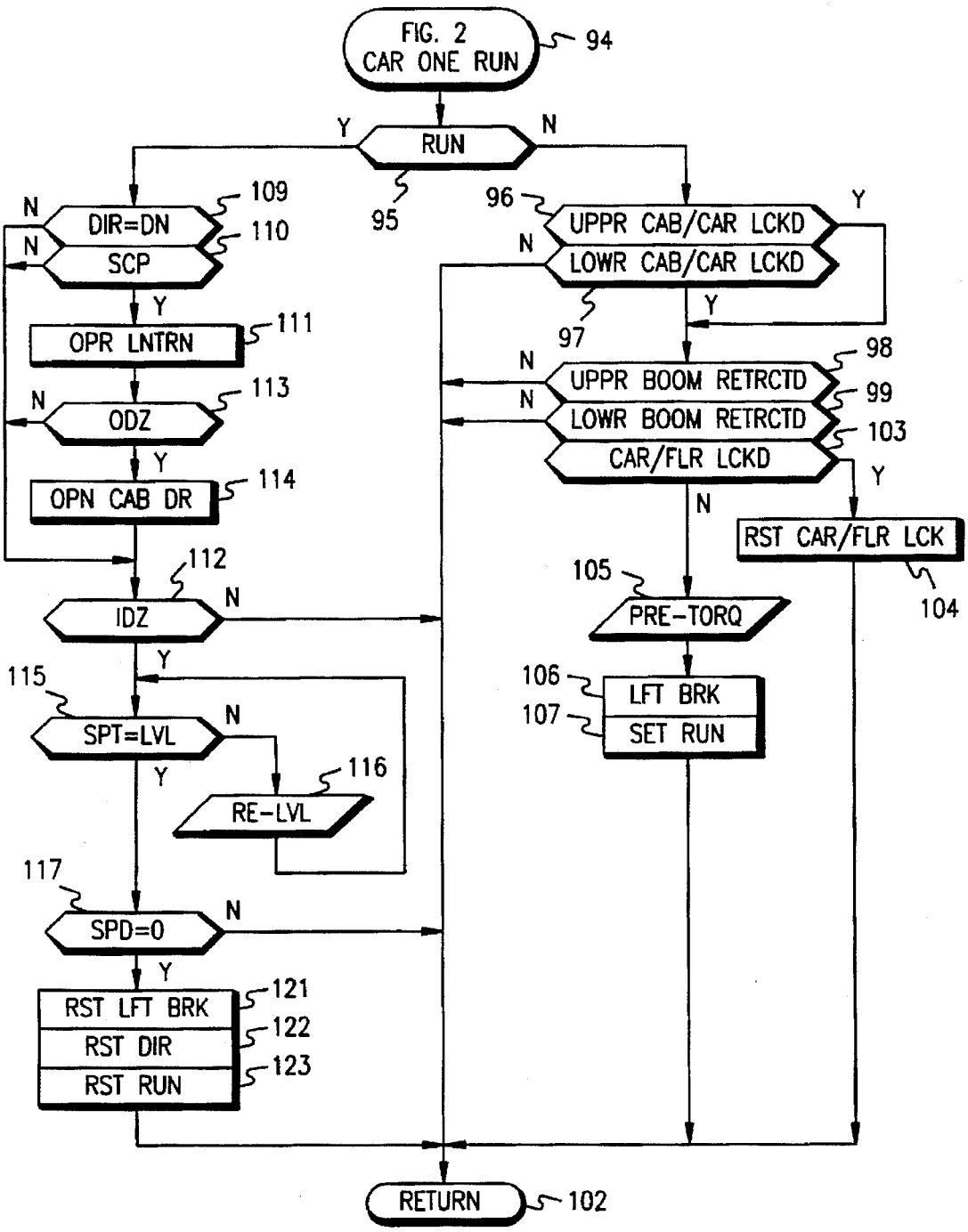
FIG. 3 is a logic flow diagram illustrating a subroutine for controlling a run of car one.

In the next pass through the routine of FIG. 2, test 82 is affirmative so a run subroutine for car one is reached in FIG. 3 through a transfer point 94.

In FIG. 3, a first test 95 is reached to determine if the car has a run command yet or not. Initially it will not have, so a negative result of test 95 reaches a pair of tests 96, 97 to see if either an upper cab/car lock or a lower car/cab lock is indeed locked. This may be a safety signal conducted by microswitches or contacts associated with the lock plungers referred to hereinbefore. The cab is locked to car one when it first enters the car (step LATER, hereinafter), and remains locked until it is transferred to car two again (step LATER, hereinafter). If the cab is locked, a pair of tests 98 determine if both the upper and lower car one booms are retracted. If either both tests 96, 97 or either test 98, 99 are negative, the car is not allowed to run; instead, other programming is reached through a return point 102. As shown in the simple embodiment of FIG. 3, negative results simply bypass establishing the run condition for the car; however, in a more complete embodiment, negative results of tests 96–99 may invoke alarms, intervention of maintenance personnel and ultimate evacuation of passengers. But if either tests 96 or 97 and both tests 98 and 99 are affirmative, a test 103 determines if the car is still locked to the floor. Initially, it is, so an affirmative result of test 103 reaches a step 104 to reset the car/floor lock, thereby retrieving the lock plungers. When the locks are released, in a subsequent pass through the routine, test 103 is negative and a pre-torque subroutine 105 is reached in which the elevator motor is supplied with proper current so as to support the elevator load in anticipation of lifting the brake. And then a step 106 orders the brake to be lifted and a step 107 sets the elevator into the run mode. Thereafter, the computer reverts to other programming through the return point 102. Once in the run mode, the car motion controller, part of the car control 40 (FIG. 1), will cause the car to move in response to a speed profile (or otherwise), in the usual way.

In the next pass through the subroutine of FIG. 3, an affirmative result of test 95 will reach a test 109 which determines if the car direction is down. If it is, a test 110 determines if the car has reached the stop control point (SCP) for the target floor (the floor below the lobby) or not. If it has, a step 111 will operate the lantern (not shown herein) at the lower deck 45 of the lobby floor. If the car has not reached the stop control point, the routine bypasses the step 111 and reaches a test 112 to determine if the car has reached the inner door zone (IDZ); prior to reaching a stop control point, test 112 will naturally be negative, causing other programming to be reached through the return point 102. Eventually, the car will reach the stop control point, and in a subsequent pass through the routine of FIG. 3, test 110 will be affirmative so that step 122 will operate the lobby lantern (including a gong) in the usual fashion. Then a test 113 determines if the car has reached an outer door zone (ODZ); initially it will not, so the program will advance through negative results of test 113 and 112 to the return point 102. Eventually, the car will reach the outer door zone, and a later pass through the routine of FIG. 3 will cause an affirmative result of test 113 to reach a step 114 which directs the doors to become open, in the usual fashion. Then, test 112 is reached and, initially, a negative result will cause other programming to be reached through the return point 102.

When the car reaches the inner door zone, an affirmative result of test 112 causes a test 115 to determine if the secondary position transducer (SPT) has indicated that the car is suitably level at a lobby floor. If not, a negative result of test 115 reaches a subroutine 116 to relevel the car, in the usual fashion. When the car is level, an affirmative result of test 115 reaches a test 117 to ensure that the car speed is zero, which might not occur for some number of milliseconds and therefore for a few passes through the routine of FIG. 3. During all of this time that the elevator is running, it is running in response to the speed profile routine portion of the car controller 40, which brings the car to a complete stop at the floor; and it may be operated in response to the releveling subroutine 116. When the car is finally at rest, a pass through the routine of FIG. 3 will have an affirmative result of test 117 which reaches a step 121 to reset the lift brake command, thereby allowing the brake to fall and arrest all motion of the elevator roping system. A step 122 resets the direction command, a step 123 resets the run mode, and other programs are reached through the return point 102.

In the scenario assumed hereinbefore—that the car is starting at the lobby floor lower deck 45 with a cab in the upper deck with doors fully open—the car will thereafter be running up, rather than down. Therefore, following steps 90–93 (FIG. 2), affirmative results of test 82 (FIG. 2) and 95 (FIG. 3) will reach a negative result of test 109 thereby bypassing steps and tests 110, 111, 113 and 114. Therefore, when running up, the first event is reaching the inner door zone, in which case an affirmative result of test 112 will check leveling and speed and thereafter drop the brake and reset direction and run mode, in the steps 121–123, as described hereinbefore.

After direction has been reset in the step 122, the next pass through the routine of FIG. 2 will once again have a negative result of test 82. This reaches test 83 once again, but this time, the car is standing at its transfer floor so an affirmative result of test 83 reaches a test 128 to see if the upper transfer flag has been set; since the upper transfer flag has previously been set in step 90, an affirmative result of test 128 reaches that portion of the routine that causes a cab to be moved from the upper deck of frame 26 of car one to frame 27 of car two. A test 129 determines if an upper eject flag has been set, or not; this is a flag that identifies the fact that the cab is in transit between the upper decks of frame 26 and frame 27. Initially, it will not have been set, so a negative result of test 129 reaches a test 130 to see if a car/floor interlock has been established yet or not. The car/floor interlock is not shown; in this embodiment at a transfer floor, it is contemplated as consisting of safety circuitry connected through contacts or microswitches on both cars at the transfer floor that will provide an affirmative signal to the test 130 only when all floor lock plungers are extended on both frame 26 and frame 27, so both are locked to the building floor. When car one first reaches the transfer floor, the plungers may already have been in place locking frame 27 to the building, but the plungers will not as yet have been extended to lock frame 26 in place. Therefore, a negative result of test 130 reaches a test 131, to ensure that the car speed is still zero, and a test 132 to ensure that the brake has not been lifted, meaning it is safe to engage the plungers and lock the car to the building floor. Thus, an affirmative result of test 131 and a negative result of test 132 will reach a step 133 to set the floor lock, which causes the plungers to extend and engage the plates (e.g., 60) thus locking the frame 26 (of car one) to the building floor.

A step 134 then causes an upper communications boom (not shown) to extend, which rotates the distal end thereof outwardly over the sill 60 so as to cause the cab socket/plug assembly to be in the position where it may be engaged by the socket/plug assembly on a boom of car two. And a step 135 requests that the upper boom of car two be extended. This request is passed from the control of car one to the control of car two and utilized in the same manner as described with respect to test 163 and step 164 for car one, hereinafter. After requesting that the upper car two boom be extended, the computer reverts to other programming through the return point 85.

In the next pass through the routine of FIG. 2, a negative result of test 82, affirmative results of tests 83 and 128, a negative result of tests 129, and an affirmative result of test 130 will reach a test 139 to see if an upper communication interlock has been established or not. In this embodiment, this is contemplated as being a signal which must pass outwardly from the car one electric system, to the cab 22 through its umbilical cable, through connectors on socket/plugs of car one, back out through the umbilical cable, over circuits in the car two electric system, and back through the car one electric system. Since it takes more than a few milliseconds for the booms to extend toward each other, there may be quite a few passes through the routine of FIG. 2 during which a negative result of test 139 will cause a reinforcing of steps 134 and 135 to ensure that the booms are extended. Eventually, the booms will be sufficiently extended so that the three socket/plug assemblies (car one, cab and car two) are interconnected, and therefore there will be completion of a communication interlock signal; an affirmative result of test 139 will reach a step 140 to reset the upper car/cab lock, thereby causing the plungers to retract and cause the cab 22 to become free of the frame 26. Then a test 141 may determine if the car/cab locks are clear or not. This may be done with microswitches or contacts on the plungers to provide a signal only when all plungers are free of the cab 22. Since it will take more than a few milliseconds to move the car/cab lock plungers into the unlocked condition, an affirmative result of test 151 will cause other programming to be reached through the return point 85. In a subsequent pass through the routine of FIG. 2, eventually, the car/cab locks will be clear, so that a negative result of test 141 will reach a step 142 to set a flag indicating that the upper transfer is ready and then reaches a test 143 to determine if a similar flag has been set by the car two lower subroutine (not shown). Requiring that both the upper deck of car one and the lower deck of car two are ready at the same time, synchronizes the operation for simultaneous transfer of a cab in the upper deck of car one to the upper deck of car two simultaneously with transferring another cab from the lower deck of car two to the lower deck of car one. When both are ready, a negative result of test 141 will pass through step 142 and an affirmative result of test 143 will reach a step 148 to cause the motive means 66 to eject the upper cab (as depicted in FIG. 1), which causes the jack screw assembly 66 to energize and push the cab 23 off the upper deck of frame 26, over the sill, and onto the frame 27. As soon as the eject cab signal is provided, a step 149 sets an upper eject flag to indicate that the cab is traveling between cars, in limbo.

As the cab 23 is moved horizontally by the jack screw assembly 66 from the frame 26 to the frame 27, the proximal end of the cab's umbilical cord will maintain communication until the cab 23 is in its new operational position on the frame 27. When that happens, as is described with respect to Fig. LATER hereinafter, the car two control will request release of car one's upper boom so that a plunger will push the car one socket/plug assembly out of contact with the cab socket/plug assembly. When this occurs, the communication interlock is broken because it no longer extends from the car one control through the car one boom to the cab, through the car two boom, through the car two control to the car one control. Therefore, a test 150 will be affirmative until car two requests release of the car one boom in the manner described hereinafter; but once the car one boom is released, the communication interlock will be broken, so a negative result of test 150 will reach a step 151 which causes the upper communications boom of car one to retract so as to ensure that it will not interfere with the motion of either car one or car two. A test 152 determines if the cab has been transferred sufficiently onto the upper deck of the frame 27 so as to indicate that the cab is in car two. As the cab is moved from one frame to the other, it will initially not be fully on the second frame as shown in FIG. 1, and therefore a negative result of test 152 will cause other programming to be reached through the return point 85.

Subsequent passes through the routine of FIG. 2, as the cab continues to be moved toward car two, will find a negative result of test 82, and affirmative results of tests 83, 128 and 129, reaching test 150. Once the communication interlock is broken, a negative result of test 150 will reach test 152. Eventually, the cab will be fully on the frame 27, so that a proximity sensor will provide a cab in upper car two signal, and an affirmative result of test 152 will reach a step 153 that resets the one upper ready flag (set in step 142), which must remain available until the ejection of the cab from car two lower deck has been ordered. Then, a step 154 resets the upper eject flag (indicating that the transfer is complete), and a step 155 resets the transfer upper flag (thereby indicating that a cab is not to be moved off the upper deck at the next landing). In this fashion, the transfer of a cab from the upper deck of car one to the upper deck of car two is completed, and other programming is reverted to through the return point 85.

Now that the cab has been transferred from car one to car two, the car one upper deck control simply sits and waits, while car one takes a cab in its lower deck to the lobby and back, and until car two brings the cab 23 back down to the first transfer floor, after which the cab 23 will be transferred back into the upper deck of car one. In all of the ensuing passes through the routine of FIG. 2 until the lower deck control for car one sets the car one direction command to down, a negative result of test 82 will occur. Initially, car one will still be at the transfer floor so an affirmative result of test 83 will reach test 128 to see if there is a transfer upper flag still outstanding. After transferring the upper cab to car two, the flag was reset in step 155, so a negative result of test 128 will reach a test 161 which senses if a cab is in the upper deck of car one. In this case, it is not, so a negative result of test 161 reaches a step 162 which simply reaffirms that the plungers of the upper cab/car lock are out of the way. Then a test 163 determines if car two is trying to transfer the cab over to car one, in which case it would request that the upper boom be extended. Eventually, the lower deck control (which is the same as the upper deck control, as described hereinafter) will establish that the cab in the lower deck has closed its doors and because it is at the transfer floor, it will set the car direction to down. In a next subsequent pass through either the car one upper deck routine or the car one lower deck routine, the car one run routine of FIG. 2 is reached. It is irrelevant that a car is in the lower deck, because regardless of which routine reaches FIG. 3 (upper or lower deck), the doors will be opened if the car is running down and not if they are not, and one of the cabs will be locked to the car so that one of the tests 96, 97 will be satisfied. If desired, a simple interlock may be provided so that the subroutine of FIG. 3 is only called by either the upper deck routine of FIG. 2 or the lower deck routine, but not both; however, this is beyond the invention herein. When the car gets to the lobby floor with a cab in its lower deck, eventually direction will be reset so that a negative result of test 82 will reach test 83. Test 83 will be negative since the car is at the lobby floor, so the subroutine 84 to close the upper car doors will be reached. But since no signals will be provided from a cab in the upper deck indicating the conditions of its doors, the subroutine 84 will always simply transfer to the return point 85, thereby causing a quick pass through the routine of FIG. 2. Eventually, car one may once again be ready to move upwardly with a cab in its lower deck. In such case, it will once again establish direction for car one, so once again an affirmative result of test 82 will reach FIG. 3 (unless it is interlocked, as described). When car one arrives at the transfer floor and resets direction, a negative result of test 82 will reach test 83. Now test 83 will be affirmative reaching test 128, which however is negative (there being no cab in the upper deck). This will reach the test 161 again, the negative result of which causes the upper car cab lock to be redundantly reset in step 162 and then reaches the test 163 to see if a new cab is about to be transferred into the upper deck. Eventually, the cab 23 will be brought back down to the first floor in the upper deck of car two, and as is described more fully with respect to FIG. 4, car two will request that the upper boom of car one be extended, to make communication between the cab and car one so the cab can be transferred to the upper deck of car one. When that happens, an affirmative result of test 163 will reach a step 164 to extend the upper boom. In the next several passes through the routine of FIG. 2, a negative result of test 161 will again cause all of the steps and tests 162–164 to be repeated. This is the period of time when the cab is transferring from the car two upper deck to the car one upper deck.

Eventually, the car two upper jack screw assembly 67 will have pushed the cab 23 all the way onto the upper deck of the frame 26 of car one so that the proximity sensor of the car one upper deck picks up the fact that the cab 23 is now in the car one upper deck. The next pass through the routine of FIG. 2 will reach an affirmative result of test 161, which reaches a step 169 to set the upper cab/car lock and a step 170 to release the upper boom of the other car, which in this case is always car two, which causes a plunger to push the socket/plug assembly of the car two upper deck 71 away, thereby separating the upper boom from the cab, while leaving the cab connected to the boom of car one. Then a test 171 determines if the communication connection has been separated from car two. Initially it may not be separated, so the communication interlock signal is still being provided, and an affirmative result of test 171 will cause the computer to revert to other programming through the return point 103. As soon as the communication interlock is broken, in a next pass through the routine of FIG. 2, a step 172 causes the upper boom of car one to retract, a step 173 sets the target floor to the floor below the lobby, so that the upper deck will be at the lobby floor 45, and a step 174 sets the car one direction command to down.

Figure 4A:
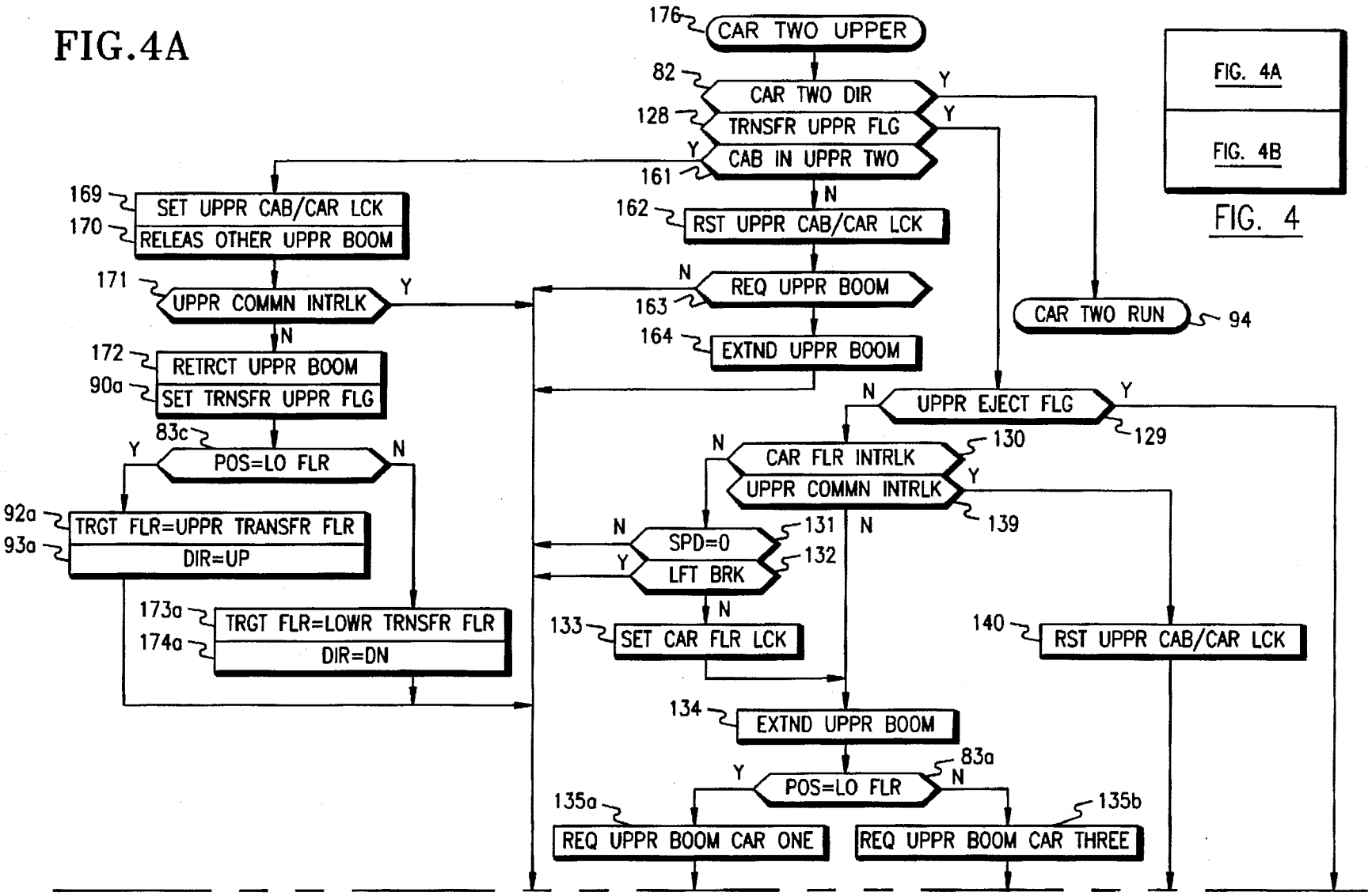
FIG. 4 is a logic flow diagram illustrating a portion of a routine which may be used controlling car two in the middle shaft of FIG. 1, with a cab in its upper deck.
Figure 4B:
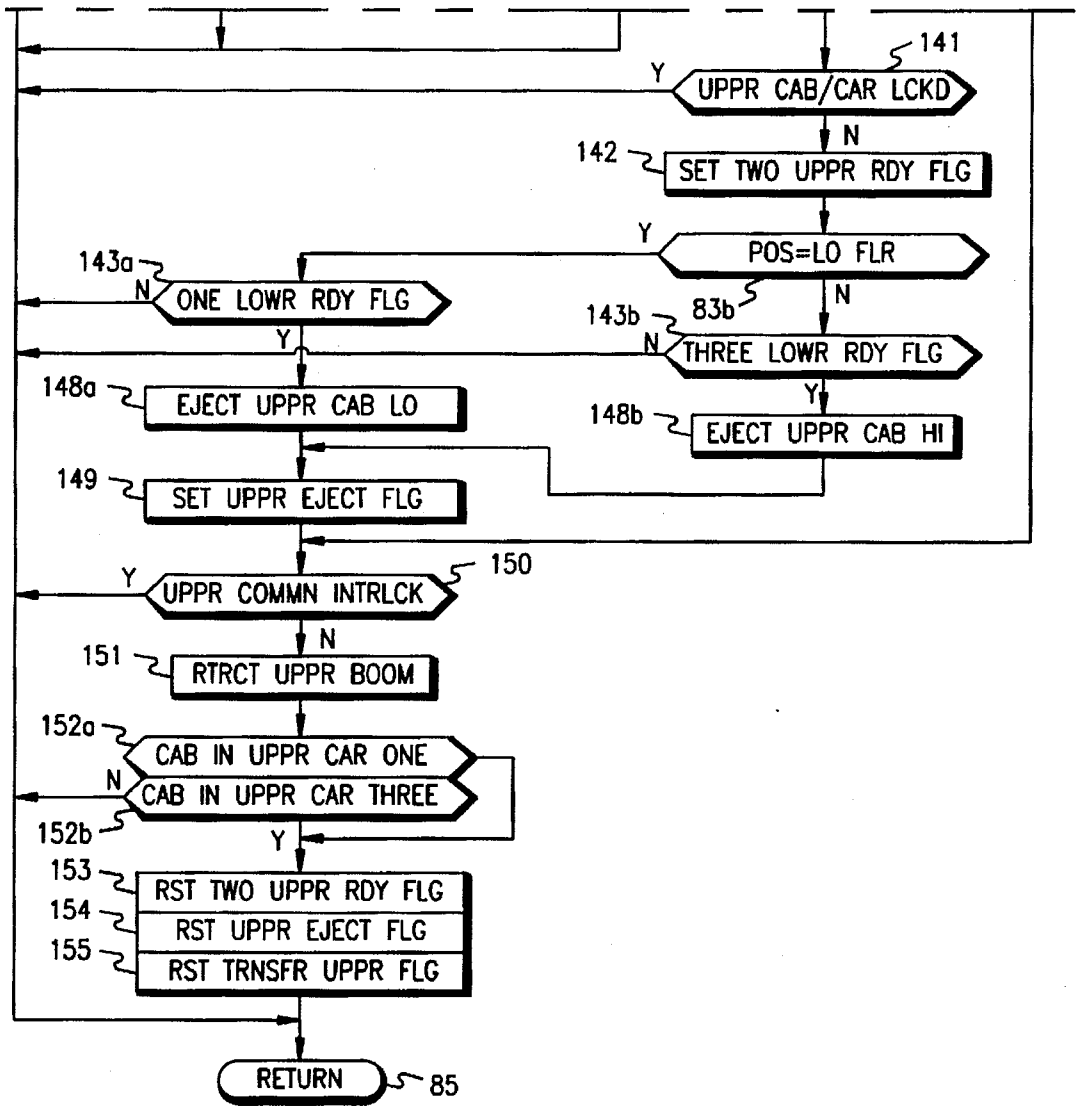

The very next pass through the routine of FIG. 4 therefore has an affirmative result of test 82 so that all of the tests and steps 94–103 will be repeated as the elevator will start up, travel downwardly, open its doors and become level with its upper deck at the lower deck 45 of the low lobby floor. Then, operation will repeat, as described hereinbefore.

A control routine for the upper deck of car two is illustrated in FIG. 4. The control for car two differs from that of car one mainly in two respects: since it travels between two transfer floors, there is no door control function required; and since the cabs are transferred between car one and car two at one end of a run and between car two and car three at the other end of a run, the transfer command must be given during each run, and car two interacts with both car one and car three.

The car two upper deck control routine is reached in FIG. 4 through an entry point 176. The upper deck control routine for car two is identical to the car one upper deck control routine of FIG. 2, except for particulars relating to transferring at either end of its run to either of two different cars. In FIG. 4, every step and test which has the fully equivalent function of a similar step or test in FIG. 2 is given exactly the same reference numeral as that in FIG. 2. In such case, the step or test is identical except relating to car two, rather than car one. For instance, test 82 in FIG. 4 is the identical function for car two as test 82 is for car one in FIG. 2. An affirmative result of test 82 in FIG. 4 reaches a car two run subroutine through a transfer point 94, the subroutine being identical to that illustrated in FIG. 3 except relating to car two. In FIG. 4, there is no test 83, instead, there are three similar tests **83*a*–83*c* relating to which end of the hoistway car two is on. For instance, test 83*a* determines if an upper communications boom should be requested from car one in step 135*a* or should be requested from car three in step 135*b*. Test 83*b* determines if car two should wait for the car one lower ready flag in test 143*a* and eject the upper cab at the low end of its hoistway in step 148*a*, or wait for the car three ready lower flag in test 143*b* and then eject the upper cab at the high end of the car two hoistway in step 148*b*. Similarly, test 83*c* determines if the target floor should be set to the upper transfer floor in step 92*a* and the direction of car two set to up in step 93*a*, or the target floor should be set to the lower transfer floor in step 173*a* and the direction set to down in step 174*a*. One other difference between FIG. 4 and FIG. 2 is that the tests 152*a* and 152*b* determine if a cab transferred from car two has lodged completely in either car one or car three. The remainder of FIG. 4 is functionally identical to FIG. 2** and is not described further.

A car three upper control routine, not shown herein, is identical to the car one upper deck control routine illustrated in FIG. 2 except that all of the functions relate to car three and step 93 would set the direction to down and step 174 would set the direction to up. The target floor for the car in step 173 would be one less than the upper lobby floor (rather than the basement as is the case for car one), to allow upper deck passengers access to the lower level 51 of the sky lobby. Note that the upper doors 56–58 of the lobby and sky lobby are provided in this embodiment just for emergency, safety purposes. However, if desired, the cars could be stopped at the same level in each case and the upper lobbies could be used for access to the upper deck cabs, if desired.

Lower deck control routines for all three cars are the same as the upper deck control routines with the exception of the fact that the terms "upper" and "lower", and the equipment interfacing with the routines will commensurately change in an appropriate fashion, all as is obvious in view of the teachings hereinbefore with respect to FIGS. 2–4.

Figure 5:
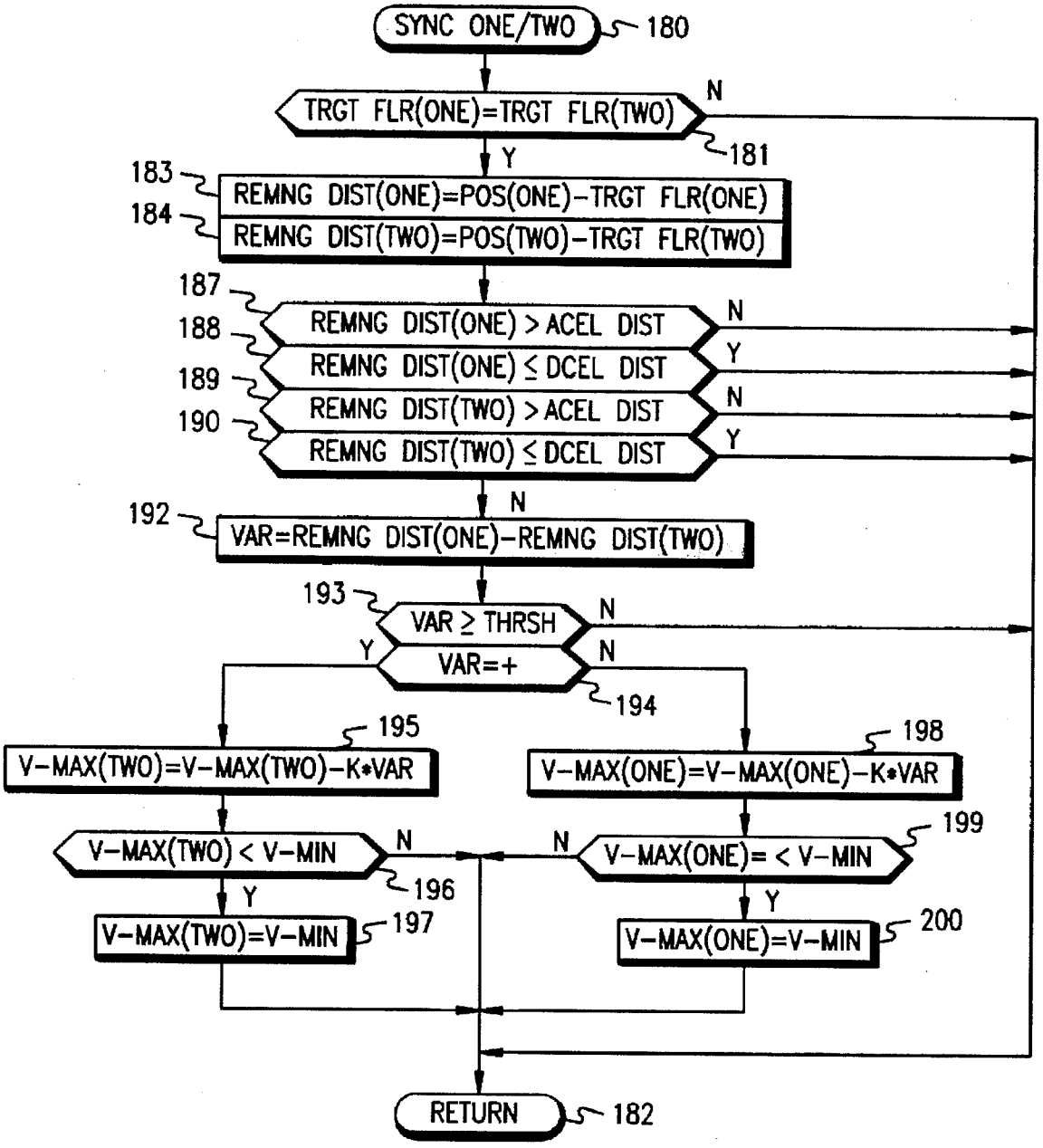
FIG. 5 is a logic flow diagram illustrating a routine which may be used to synchronize two cars approaching a transfer landing.

A routine may be utilized to synchronize the approach of two cars to a transfer floor, so that horizontal cab movement begins in both cars as soon as the cars are stopped, thereby to avoid passenger anxiety. In FIG. 5, a synchronizing routine for cars one and two may be reached through an entry point 180, and a first test determines if both cars have the same target floor; if not, this means that car one is headed for the lobby and car two is headed for the upper transfer floor, and there is no point in synchronizing them. Therefore, a negative result of test 181 causes other programming to be reverted to through a return point 182. When both cars are headed for the lower transfer floor, an affirmative result of test 181 reaches a step 183 to calculate the remaining distance for car one as the difference between its present position and the position of the target floor for car one. A step 184 similarly determines the remaining distance for car two. Then a test 187 determines if the absolute value of the remaining distance for car one is less than some initial distance which the cars normally utilize to accelerate. If it is, synchronizing is not yet to be attempted, so a negative result will reach the return point 182. But if test 187 indicates car one has reached the maximum velocity portion of a normal velocity profile, a test 188 determines if it has yet reached that portion of the profile where deceleration may begin. If it has, an affirmative result of test 188 similarly will bypass the remainder of the program. Tests 189 and 190 in the same fashion determine whether car two is within the nominal maximum velocity portion of its velocity profile. If not, the routine is bypassed. If both cars are in that portion of their velocity profile that normally causes the car to run at a target maximum velocity, the tests 187–190 will reach a step 192 in which the variation in remaining distance between the two cars is calculated. The absolute value of this variation may be checked in a test 193 for a threshold to avoid unnecessary hunting in velocity which could cause passenger anxiety. If the variation is sufficient, an affirmative result of test 193 reaches a test 194 to see which of the two cars has the longest distance to go. If the result of step 192 is positive, car one has a greater distance to go so car two should be slowed down so that the two cars will arrive at a transfer floor at nearly the same time. An affirmative result of test 194 therefore reaches a step 195 to adjust a maximum velocity utilized in control of car two by an amount proportional to the variation in the remaining distance. Instead, predetermined adjustments, equal to a given small percent of Vmax, so as not to disturb the passengers, may be made in subsequent passes through FIG. 5. Then a test 196 determines if the adjusted maximum velocity for car two is less than some minimum value of maximum velocity which may be established for ride comfort purposes. If the adjusted maximum velocity for car two is less than some minimum value, a step 197 may set it at that minimum value. Similar steps and tests 198–200 will adjust the maximum velocity of car one if car two has a longer distance remaining.

The invention may be practiced with other synchronizing routines. Or, if desired, the invention can be accomplished without use of the synchronizing routine.

The invention is disclosed as using simple jack screw systems 64–71 which permit each car to push the cab off itself onto another car.

Figure 6:
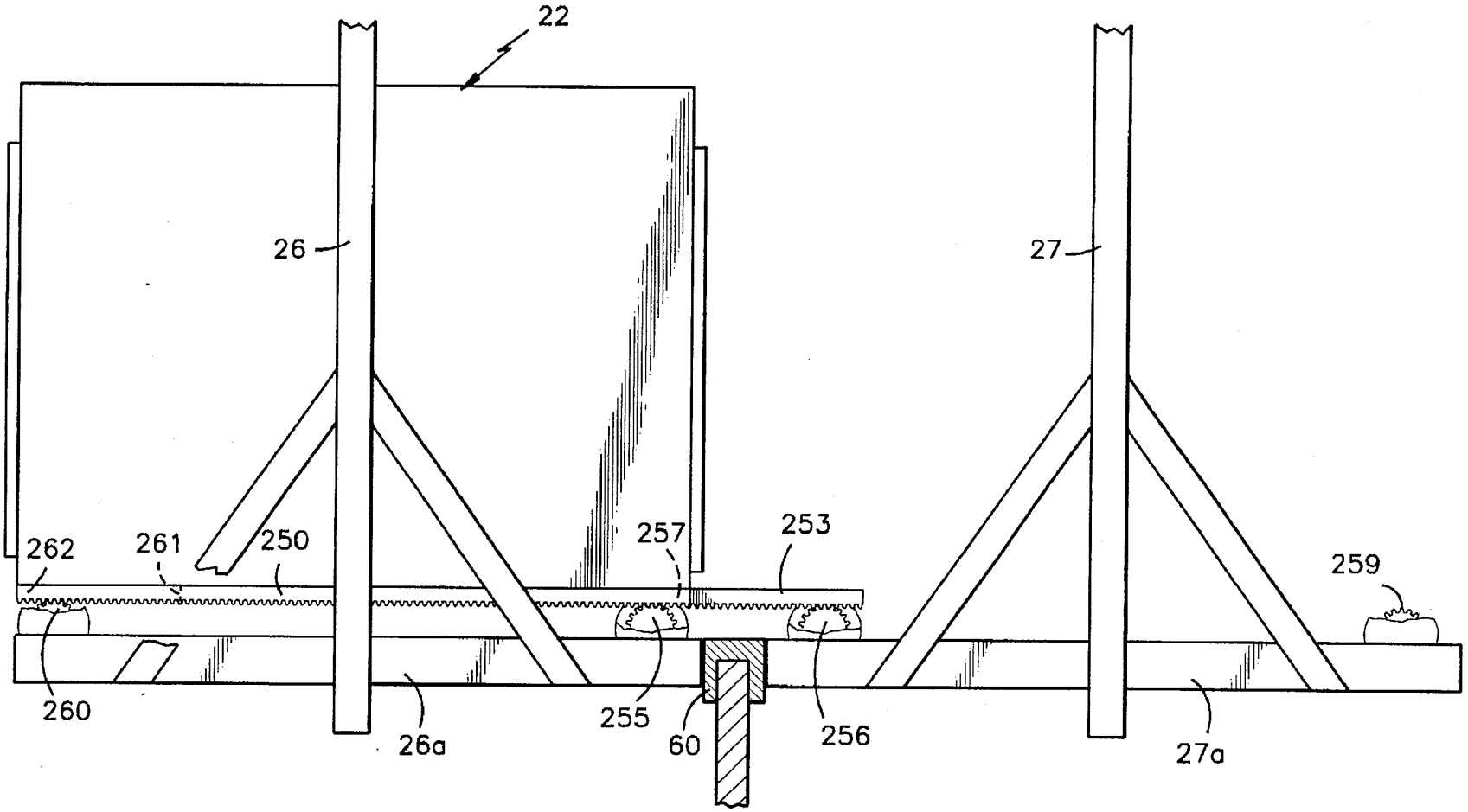
FIG. 6 is a simplified side elevation view of car frames and a cab, illustrating a second horizontal motive means which the invention may use.

In FIG. 6, the bottom of the cab 22 has a fixed, main rack 250 extending from front to back (right to left in FIG. 6), and a sliding rack 253 that can slide outwardly to the right, as shown, or to the left. There are a total of four motorized pinions on each of the car frame platforms 262, 272. First, an auxiliary motorized pinion 255 turns clockwise to drive the sliding auxiliary rack 253 out from under the cab into the position shown, where it can engage an auxiliary motorized pinion 256 on the platform 272, which is the limit that the rack 253 can slide. Then, the auxiliary motorized pinion 256 will turn clockwise pulling the auxiliary rack 253 (which now is extended to its limit) and therefore the entire cab 14 to the right as seen in FIG. 6 until such time as an end 257 of the main rack 250 engages a main motorized pinion (not shown) which is located just behind the auxiliary motorized pinion 256 in FIG. 6. Then, that main motorized pinion will pull the entire cab 22 fully onto the platform 27*a* by means of the main rack 250, and as it does so a spring causes the slidable auxiliary rack 253 to retract under the cab 22. An auxiliary motorized pinion 259 can assist in moving the cab 22 to the right to another car frame or landing (if any). Similarly, an auxiliary pinion 260 can assist in moving a cab from a car frame or landing to the left of that shown in FIG. 6 (if any) onto the platform 51.

To return the cab 22 from the platform 27*a* to the platform 26*a*, the auxiliary pinion 256 will operate counterclockwise, causing the sliding, auxiliary rack 253 to move outwardly to the left until its left end 261 engages the auxiliary pinion 256. Then the auxiliary pinion 255 pulls the auxiliary rack 253 and the entire cab 14 to the left until the left end 262 of the main rack engages a main motorized pinion (not shown) located behind the auxiliary motorized pinion 255, which then pulls the entire cab to the left until it is fully on the frame 26*a*.

All of the aforementioned patent applications are incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. An elevator system for a building having a plurality of levels, comprising:

a plurality of overlapping elevator hoistways, each having a double deck elevator car frame movable from a low end of the corresponding hoistway to a high end of the corresponding hoistway, each hoistway except the lowest of said hoistways in said building having its low end at the same building level as the high end of another of said hoistways, each hoistway except the highest of said hoistways in said building having its high end at the same building level as the low end of another one of said hoistways, said lowest of said hoistways having a passenger lobby at its low end, said highest of said hoistways having a passenger lobby at its high end;

a plurality of moveable elevator cabs, each having passenger access doors;

selectively operable lower motive means for moving said cabs horizontally from the lower deck of a first one of said car frames to the lower deck of a second one of said car frames or, alternatively, from the lower deck of said second car frame to the lower deck of said first car frame;

selectively operable upper motive means for moving said cabs horizontally from the upper deck of said first car frame to the upper deck of said second car frame or, alternatively, from the upper deck of said second car frame to the upper deck of said first car frame;

means for sensing the presence of said cab in the lower deck of any one of said car frames and providing a corresponding cab-in-lower-deck signal indicative thereof;

upper means for sensing the presence of said cab in the upper deck of any one of said car frames and providing a corresponding cab-in-upper-deck signal indicative thereof;

means for sensing the position of said car frames in said hoistways and providing corresponding position signals indicative thereof;

signal processing means responsive to said position signals indicating that one of said car frames is at a corresponding one of said lobby floors for providing door control signals to open and close said doors for transfer of passengers, for providing, after said cab doors have been open and are fully closed, a first car direction command for said one car frame indicating a direction away from said one lobby floor and either a transfer upper signal or a transfer lower signal indicative, respectively, of the fact that said cab shall be transferred from a corresponding one of said decks, upper or lower, of said one car frame to a corresponding deck, upper or lower, of another of said car frames, said signal processing means, in response to said position signals indicating that said car is at a location other than one of said lobby floors concurrently with the absence of either of said direction commands for said one car and the presence of said car-in-lower-deck signal for said one car, either operating said lower motive means in response to said transfer lower signal for said one car, to transfer a cab from the lower deck of said one car to the lower deck of said another car frame while simultaneously operating said upper motive means in response to said transfer upper signal for said another car frame to transfer a cab from the upper deck of said another car to the upper deck of said one car;

operating said upper motive means in response to said transfer upper signal for said one car, to transfer a cab from the upper deck of said one car to the upper deck of said another car frame while simultaneously operating said lower motive means in response to said transfer lower signal for said another car frame to transfer a cab from the lower deck of said another car to the lower deck of said one car frame;

or otherwise, in the absence of both said transfer lower signal and said transfer upper signal for said one car frame, providing a second car direction command for said one car frame indicating a direction away from said location; and a car motion means for each of said car frames, each responsive to the presence of corresponding ones of said car direction commands for moving the corresponding car frame along its hoistway in the direction indicated by the present one of said corresponding car direction commands.

2. An elevator system, comprising:

a plurality of overlapping elevator hoistways, each extending between a corresponding lower terminal level and a corresponding upper terminal level, one terminal level of each of said elevator hoistways being coextensive at a transfer floor with one terminal level of another one of said elevator hoistways, the lower terminal level of one of said elevator hoistways comprising a lower lobby and the upper terminal level of another of said elevator hoistways comprising an upper lobby, any of said terminal levels which does not comprise a lobby comprising a transfer floor;

a plurality of elevator cars, each comprising a frame movable between said terminal levels of a corresponding one of said hoistways, each frame having an upper deck and a lower deck;

a plurality of moveable elevator cabs;

selectively operable lower motive means for moving said cabs horizontally from the lower deck of a first one of said car frames to the lower deck of a second one of said car frames or, alternatively, from the lower deck of said second car frame to the lower deck of said first car frame;

selectively operable upper motive means for moving said cabs horizontally from the upper deck of said first car frame to the upper deck of said second car frame or, alternatively, from the upper deck of said second car frame to the upper deck of said first car frame;

lower means for sensing the presence of said cab in the lower deck of any one of said car frames and providing a corresponding cab-in-lower-deck signal indicative thereof;

upper means for sensing the presence of said cab in the upper deck of any one of said car frames and providing a corresponding cab-in-upper-deck signal indicative thereof;

means for sensing the position of said car frames in said hoistways and providing corresponding position signals indicative thereof;

signal processing means for providing a transfer lower signal for each one of said cars each time the corresponding car runs toward one of said transfer levels with a cab in its lower deck, for providing a transfer upper signal for each one of said cars each time the corresponding car runs toward one of said transfer levels with a cab in its upper deck, said signal processing means comprising means, responsive to the absence of a car direction command signal for said one car in the presence of the corresponding one of either said cab-in-lower signals or said cab-in-upper signals, for either in the absence of either said transfer upper signal or said transfer lower signal for said one car, providing a car direction command signal for said one car indicative of a direction command away from said one level, or in the presence of said transfer lower signal for said one car, operating said lower motive means to transfer one of said cabs from the lower deck of said one car to the lower deck of another one of said cars, or in the presence of said transfer upper signal for said one car, operating said upper motive means to transfer one of said cabs from the upper deck of said one car to the upper deck of another one of said cars; and a car motion means for each of said cars, each responsive to the presence of corresponding ones of said car direction commands for moving the corresponding car along its hoistway in the direction indicated by the present one of said corresponding car direction commands.

3. An elevator system according to claim 2, wherein said signal processing means comprises means for either in the presence of said transfer lower signal for said one car, operating said lower motive means to transfer said cab from the lower deck of said one car to the lower deck of another one of said cars simultaneously with operating said upper motive means to transfer another one of cabs from the upper deck of said another one of said cars to the upper deck of said one car, or in the presence of said transfer upper signal for said one car, operating said lower motive means to transfer said another one of said cabs from the upper deck of said one car to the upper deck of said another one of said cars simultaneously with operating said lower motive means to transfer said one cab from the lower deck of said another one of said cars to the lower deck of said one car.

* * * * *